United States Patent [19]

Miller

[11] Patent Number: 4,830,533

[45] Date of Patent: May 16, 1989

[54] ASPHALT PATCHING DEVICE

[75] Inventor: Garl Q. Miller, Shelley, Id.

[73] Assignee: Idaho Fluid Power, Inc., Idaho Falls, Id.

[21] Appl. No.: 62,496

[22] Filed: Jun. 15, 1987

[51] Int. Cl.[4] ..... E01C 19/22

[52] U.S. Cl. ..... 404/101; 404/109; 404/110; 222/168; 239/672

[58] Field of Search ..... 404/101, 102, 107, 108, 404/109, 110, 83; 222/168; 239/672, 687

[56] References Cited

U.S. PATENT DOCUMENTS

| | | | |
|---|---|---|---|
| 1,613,051 | 1/1927 | Napier | 404/101 |
| 3,967,913 | 7/1976 | Gabriel, Jr. | 404/109 |
| 4,253,612 | 3/1981 | Schulze | 239/672 |
| 4,322,178 | 3/1982 | Lee | 404/83 |
| 4,579,479 | 4/1986 | Bryant | 404/107 X |
| 4,676,689 | 6/1987 | Yant | 404/110 |

FOREIGN PATENT DOCUMENTS

| | | | |
|---|---|---|---|
| 2527663 | 12/1983 | France | 404/108 |
| 8606119 | 10/1986 | Sweden | 404/108 |

*Primary Examiner*—Jerome Massie
*Assistant Examiner*—Matthew Smith
*Attorney, Agent, or Firm*—Hopkins, French, Crockett, Springer & Hoopes

[57] ABSTRACT

The invention provides an asphalt patching device capable of single-handed operation, reducing the time and expense of conventional asphalt patching. The device comprises an auger, a hopper with an associated spreader, a conveyor to transport asphalt from the auger to the hopper, and an operator's station. This device, exclusive of the hopper, is mounted to a wheeled frame which is pulled behind a dump truck carrying the asphalt. The frame is provided with wheels which permit the device to rotate substantially 180° side-to-side behind the truck in order to effect asphalt patches on a roadway.

19 Claims, 3 Drawing Sheets

ASPHALT PATCHING DEVICE

BACKGROUND OF THE INVENTION

This invention relates to an asphalt patching device, and specifically a device operable by a single person, with or without the need for a support vehicle driver.

Various attempts have been made to reduce the labor incident to patching asphalt roadways. More so than concrete roads, asphalt roads are susceptible to having "potholes", cracks, washboarding, etc., and other surface discontinuities, formed therein which require periodic maintenance to maintain a relatively smooth road bed. Typically, a dump truck having a dump truck driver and three or four other individuals, one or two for dispersing asphalt from the dump truck, and one or two for distributing the asphalt in the proper location, as well as possibly an additional individual to tamp or roll the asphalt patch, are required to make asphalt patches. Because labor costs are the predominant expense in patching such discontinuities, it would be desirable to have an apparatus which could eliminate many or most of these laborers.

Accordingly, U.S. Pat. No. 4,215,949 proposed a motorized vehicle designed for one-man operation for the patching of asphalt roadways. This device comprises a wheeled frame having a cab, a supply hopper for holding asphalt, an auger to distribute asphalt to a feed bucket which is mounted on an articulated arm. The feed bucket includes a tamper to tamp down to a job site. After arriving at the job site, the aggregate and liquid asphalt cement are mixed and delivered to the roadbed. Filler materials are carried in a separate container and added to the mixture before it is applied. While not particularly relevant to the patching of roadways with asphalt, U.S. Pat. No. 4,311,408 discloses means for delivering and applying crushed rock in measured amounts to a shoulder of a roadway.

Because only the first of the forgoing devices actually addresses the manpower needs of city, county or state road departments, albeit in a prohibitively expensive manner, it is an object of the present invention to provide an affordable, easily operable asphalt patching device which may be operated by a single individual.

SUMMARY OF THE INVENTION

The present invention comprises an asphalt patching device which includes an auger, hopper means, one or more conveyors, and adjustable spreader means, all adapted to be used in conjunction with a dump truck. Specifically, the auger is affixed across the transverse dimension of the dump truck after the tailgate has been removed. The auger can be provided with one or more discharge openings, so that asphalt contained in the dump truck can be metered to the conveyor therebelow. The conveyor preferably comprises at least two telescoping sections, such that the distance between the hopper and the dump truck can be varied. The hopper is mounted on a wheeled frame which is advantageously pulled behind the dump truck. The wheeled frame is provided with a pair of wheels, each of which is driven by an hydraulic motor, and each of which is rotatable about a vertical axis in an arc of at least 180°. Therefore, the device is able to move in an arc of 180° behind the dump truck.

The hopper comprises an upper portion that receives asphalt from the conveyors and a lower portion which determines the size and thickness of the asphalt patch.

The lower portion, in the form of spreader means, comprises transversely adjustable lateral wing members which determine the transverse dimension of the asphalt patch. The spreader means further comprise a vertically adjustable scraper means which, as the device is pulled forwardly by the dump truck, determines the thickness of the asphalt patch. The spreader means is rotatably adjustable about a vertical axis.

DETAILED DESCRIPTION OF THE PREFERRED EMBODIMENTS

Figure 1:
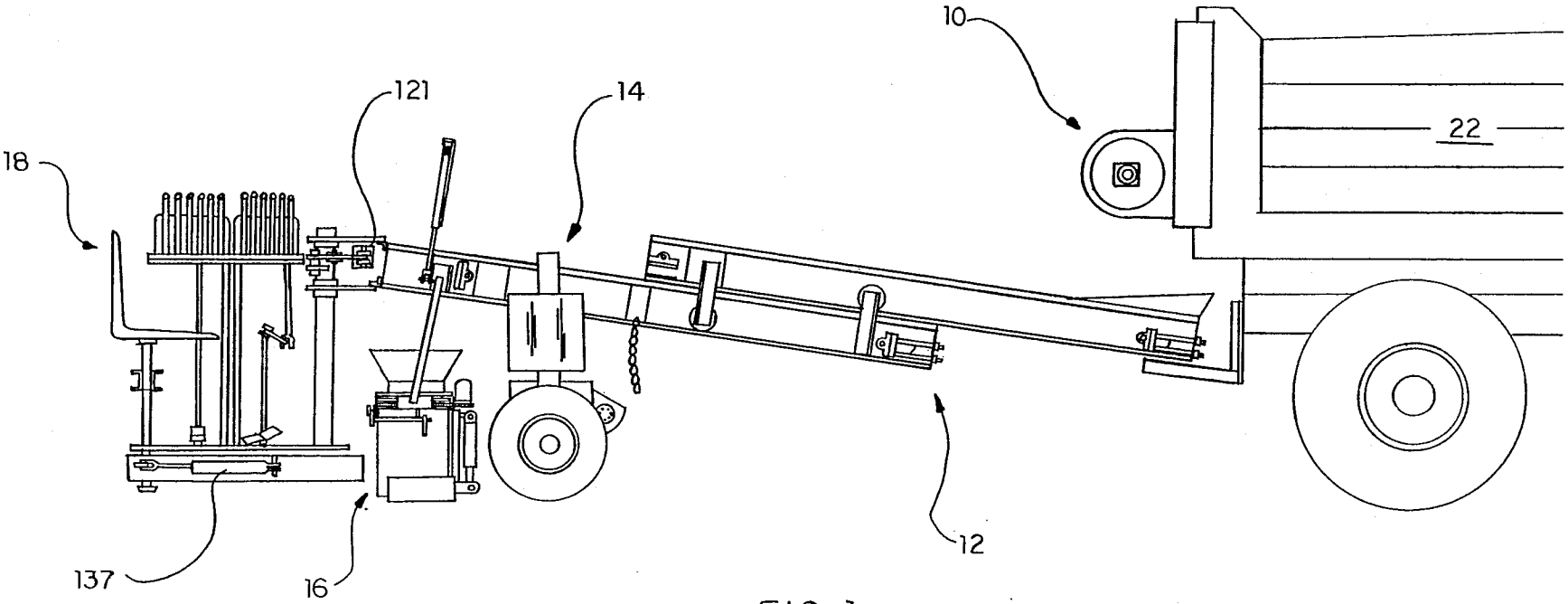
FIG. 1 is a side elevational view of a preferred embodiment of the invention.
Figure 2:
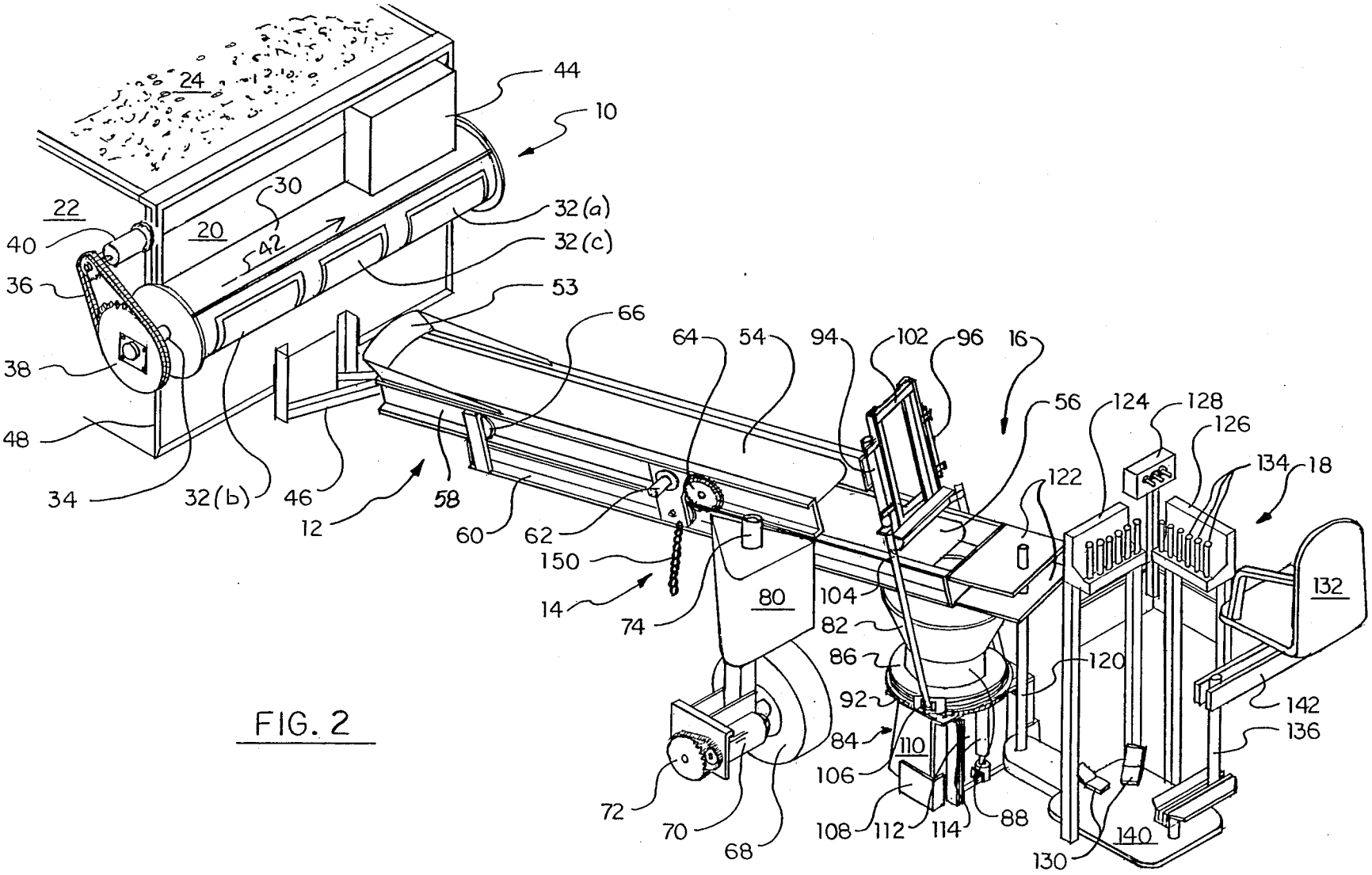
FIG. 2 a perspective view of a preferred embodiment of the present invention

In the device illustrated in FIG. 1, the device of the present invention includes an auger, shown generally at 10, a conveyor system 12, a wheeled frame 14, a hopper assembly 16, and an operator's station 18. The auger 10 is advantageously affixed to the tailgate region 20 of a dump truck 22 which is partially shown in FIG. 1. The dump truck 22 contains a quantity of asphalt 24 therein which is to be used in patching potholes, cracks or other discontinuities in the surface of an asphalt roadway.

The auger 10 may be constructed such that it totally replaces the tailgate of the dump truck, or it may be incorporated into the tailgate such that it swings therewith.

The present invention is intended primarily for use with asphalt of the "cold" type. Cold asphalts have the advantage of not requiring large amounts of heat during transport, storage and distribution at the job site. Cold asphalt is sometimes mixed with "cutbacks", such as Naphtha, diesel fuel and kerosene, or emulsified with a emulsifier to prevent the asphalt from "setting up" prior to its intended use. The present invention may be used with either of these types of cold asphalt, or it may be used with hot asphalt which is heated either prior to or during transit to the job site. Because most city and county road departments are not funded adequately enough to justify use of hot asphalt or the more expensive forms of cold asphalt, the cold asphalt most typically used by such municipalities is cold asphalt without expensive additives such as emulsifiers, cutbacks, etc. Therefore, the asphalt tends to set-up in the dump truck prior to its intended use. In order to combat the problem of large agglomerations of asphalt being applied to the road surface, the auger 10 of the present invention is designed such that it chews up the asphaltic materials contained in the dump truck and distributes a relatively fine asphaltic material to the conveyor 12. Flights of a screw-type auger (not shown) can be predetermined to provide asphalt of appropriate texture. The auger 10 comprises an auger housing 30 and one or more discharge ports 32. The auger shaft 34 is driven by, for instance, chain 36 and sprocket 38, which is in turn driven by hydraulic motor 40.

It is to be understood that while the power source described in the embodiments herein are all hydraulically powered, any other suitable power source may be utilized. Additionally, for ease of illustration, the various hydraulic hoses which are necessary to provide power to the disparate parts of the present invention have not been illustrated in the drawings. Of course, hydraulic hoses would be necessary in an apparatus constructed according to the present invention in order to transfer the hydraulic fluid between various parts of the invention.

Depending upon the degree of disintegration desired in the asphalt mix, the asphalt may be directed out of any of the various discharge ports 32. For instance, if the auger is situated such that the asphalt will move within the housing 30 in the direction of arrow 42, if a finer mixture is desired, the asphalt would be directed out of discharge port 32*a*, whereas if a courser asphalt mixture were desired, it would be directed out of discharge port 32*b*. Additionally, a dual-flight auger can be utilized such that asphalt within auger housing 30 is directed toward the center discharge port 32*c*, thereby greatly increasing the output of the auger. (Asphalt may be directed into the auger housing 30 through an adjustable elongate opening (not shown) which determines the amount of asphalt entering the auger 10. As the asphalt 24 within dump truck 22 is depleted, the dump bed must be raised in order to direct sufficient quantities of asphalt into the auger 10. The hydraulic master control unit 44 may be conveniently mounted above the auger. This unit can control not only the operation of the dump bed and auger, but can also be adapted to operate a number of functions elsewhere on the device.

The dump truck 22 must be provided with a hitch assembly 46 which permits the wheeled frame 14 to be towed behind the dump truck 22. The hitch assembly may need to be reinforced with frame members 48, especially when the operator drives the entire dump truck and wheeled frame from the wheeled frame.

Continuing with FIG. 1, the conveyor system 12 is positioned beneath the appropriate discharge port form which the asphalt will be delivered. For instance, and as illustrated in FIG. 1, the conveyor is aligned beneath the center discharge port, 32*c*. An enlarged collar 53 is provided to ensure asphalt dropping from discharge ports 32 is retained on the conveyors. The conveyor 12 is advantageously provided with a pair of conveying members 54 and 56 which are supported on, for instance, I-beams 58, 60. The conveying members 54, 56 are adapted such that they are permitted to telescope within one another in order to increase or decrease the distance between the auger 10 and hopper 16. The conveyor system 12 is adapted to transport asphalt from the auger 10 and into the hopper 16. Hydraulic motor 62 is adapted to drive chain/sprocket member 64, which in turn propels the lowermost conveying member 56 in telescoping relationship to the uppermost conveying member 54. Wheels 66 attached to the I-beam 60 permit the lower conveyor 56 to slide upon I-beam 58 of upper conveyor 54.

When the conveyors 54, 56 are being telescoped in or out in order to increase or decrease the distance between auger 10 and hopper 16, the lower conveyor 56 rolls along the ground surface supported by wheels 68. The wheels are each provided with drive means in the form of hydraulic motor 70 and chain/sprocket member 72. The wheels are permitted to rotate 360° about a vertical axis defined by shaft 74. Means to rotate the wheels are contained within housing 80, preferably in the form of an hydraulic motor and chain/sprocket means (not shown).

The hydraulic motor 70 associated with each wheel 68 is powerful enough to provide locomotion for both the loaded dump truck 22 and the wheeled frame 14. By pivoting about the vertical axis, the entire wheeled assembly 14 can be directed in an arc of about 180° behind the dump truck, either by self propulsion or when being towed by the dump truck.

The hopper assembly 16 comprises a receiving bucket 82, spreader means 84 turntable 86 and a number of hydraulically-actuated pistons, described in greater detail hereinafter. The receiving bucket 82 is positioned beneath the outlet of conveyor 56 such that asphalt conveyed from the auger 10 will be gravity-fed into he bucket 82. Collar 88 attaches the bucket 82 to the turntable 86. While the collar is illustrated herein in a generally circular configuration, the shape of the collar and the bucket 82 will in large part be determined by the transverse dimension of the spreader means 84. With a relatively small spreader means as indicated in the drawings (on the order of 2 feet in width) the bucket and collar 82, 88 may be as illustrated. However, if the spreader means 84 is intended for patching especially large areas, or applying an entirely new layer of asphalt, and is provided with a transverse dimension of, for example, 4 feet, the bucket 82 may be oval shaped in a modified frusto-conical configuration, with a generally rectangular-shaped collar.

The turntable is rotatable 360° about a vertical axis and is driven by hydraulic motor 90 and chain/sprocket member 92. If the bucket 82 and collar 88 are in a generally circular configuration, they, as well as the spreader means 84 may be securely affixed to, and rotate with, the turntable 86. However, if the bucket 82 and the collar 88 are of other than circular configuration, the turntable and spreader means may be adapted to rotate with the turntable independently of the bucket.

The spreader means 84 shown in greater detail in FIG. 3, and explained hereinafter, may be "tilted" by actuation of one or both of the hydraulically-activated pistons 94, 96 which are affixed to frame member 102. The pistons actuate articulated arm 104 which is affixed to turntable 86 or spreader means 84 at 106. Actuating one of the pistons 94, 96 will result in either raising or lowering that side of the spreader means 84 so that asphalt may be applied uniformly to a side-sloping surface.

The spreader means 84 further comprises fixed members 108 which define the largest lateral dimension of the asphalt patch to be deposited, as well as adjustable lateral wing members 110, each of which are independently operable. Lastly, a vertically adjustable transversely disposed scraper means 112 is provided, with vertical adjustability being provided by hydraulically-actuated piston 114.

The operator station 18 is affixed to and depends from the wheeled frame 14. The operator station 18 pivots as a unit about a vertical axis defined by shaft 120. 180° rotation about such axis is effected by hydraulically actuated piston 121 contained between plates 122 from which the operator station depends.

The operator station 18 comprises one or more control handle panels 124, 126 an auxiliary control panel 128, one or more foot pedals 130 and an operator seat 132. A plurality of control handles 134 operate various functions on the device. Foot pedals 130 may be adapted to operate the same, or different aspects as one or more of the control handles 134, thereby giving the operator greater flexibility in control of the apparatus.

The operator seat 132 is adapted to pivot about a vertical axis defined by shaft 136, rotation of the shaft being effected by hydraulically-actuated piston 137 beneath the floor board 140 of station 18. The seat 132 may be further adapted to rotate about a vertical axis immediately beneath the seat at the end of support arm 142.

Figure 3:
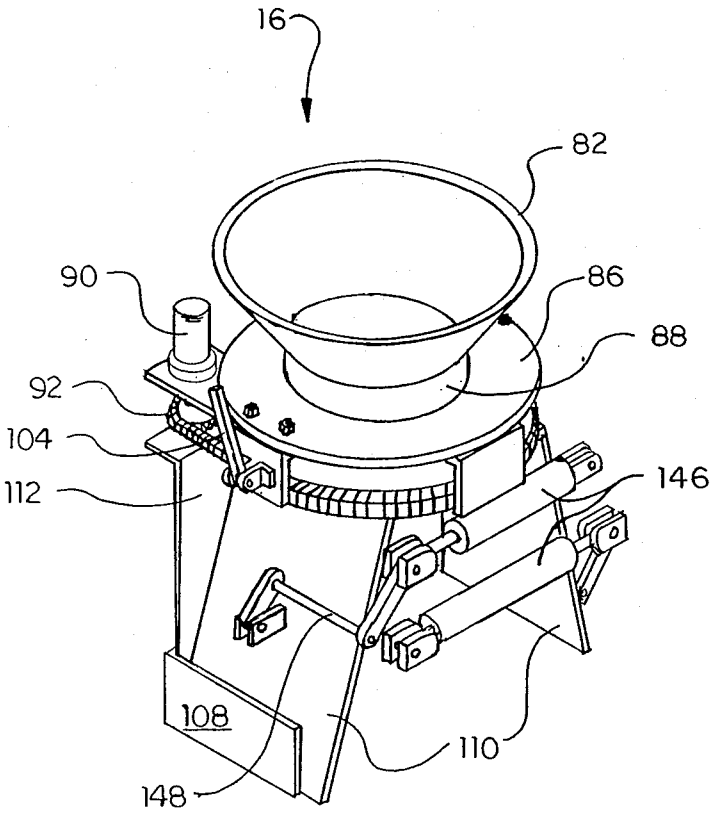
FIG. 3 is an enlarged perspective view of the hopper assembly of the invention.

As shown more specifically in FIG. 3, the hopper assembly 16 effects asphalt patching by depositing granulated asphalt through the bucket 82 and then downwardly between wing members 110 and in front of scraper means 112. The wing members are individually moveable in a transverse direction (in other words perpendicular to the direction of travel, indicated by arrow 144, in order to widen or narrow the size of the asphalt patch. Hydraulic pistons 146 activate the wing members 110 thru articulated arm 148.

The transverse scraper means 112 and the fixed members 108 are moveable vertically as a unit. Or, alternatively, a panel (not shown) may be provided which is vertically adjustable independent of the fixed members 108. As can be seen in FIG. 3, by actuation of hydraulic motor 90 and chain/sprocket means 92, the entire lower portion of the hopper assembly 16 may be rotated about a vertical axis.

OPERATION OF THE INVENTION

When being towed to a work site, the apparatus of the present invention must be readied for non-operational movement. For instance, the conveyors must be fixed so that there is no inadvertent elongation or telescoping of the conveyors during transit. Therefore, means, such as chain 150 are provided to secure the lowermost conveyor 56 to the wheeled frame, as at shaft 74. Likewise, in order to prevent unwanted side-to-side movement of the apparatus while being towed, the wheels are fixed in a straight-ahead orientation by any convenient means, such as by a lock-bar (not shown). Also during transit, the spreader means 84 is raised to its highest position in order to avoid obstacles in the roadway. Once at a work site, where a number of pot holes and/or cracks are to be filled, the auger is operated and asphalt is directed from conveyors to the hopper assembly 16. In operation, a driver in the dump truck 22 may pull the apparatus passively behind the dump truck, or the truck driver may become the operator of the patching apparatus. In the latter case, the operator may direct the dump truck in a forward or rearward direction by providing power to the hydraulic motors 70 which power the wheels 68 of the apparatus. It has been found that sufficient power can easily be provided to wheels 68 in order to provide forward locomotion for both the dump truck and the inventive apparatus. Of course, such single handed operation can only be performed on relatively level roadways where the front steering wheels of the dump truck will not be deflected from a straight-ahead path.

An operator sitting in the operator's seat 132 will have at his disposal controls 134 which are capable of performing the following duties:

1. rotate spreader means 84
2. raise and lower transverse scraper means 112
3. activate first conveyor 54 (also may be activated by foot pedal 130)
4. activate second conveyor 56 (may also be activated by foot pedal 130)
5. operate 1 adjustable lateral wing member 110
6. operate the other lateral wing member 110
7. activate motors on both wheels one lever can operate both wheels 68)
8. activate piston 94 to lower "left" side of spreader means 84
9. activate piston 96 in order to lower "right" side of spreader means 84
10. activate piston 121 in order to rotate operator station about first axis 120
11. activate piston 137 in order to rotate operator seat 132 about axis 136
12. activate steering mechanism within housing 80 in order to rotate wheels 68 about axis 74. The operator will also have at his finger tips the auxiliary control panel 128 with, for instance, toggle switches which raise or lower the dump bed of the dump truck, turn the auger on and off and provide dual speed range for one or more of the hydraulic systems provided herein.

Figure 4:
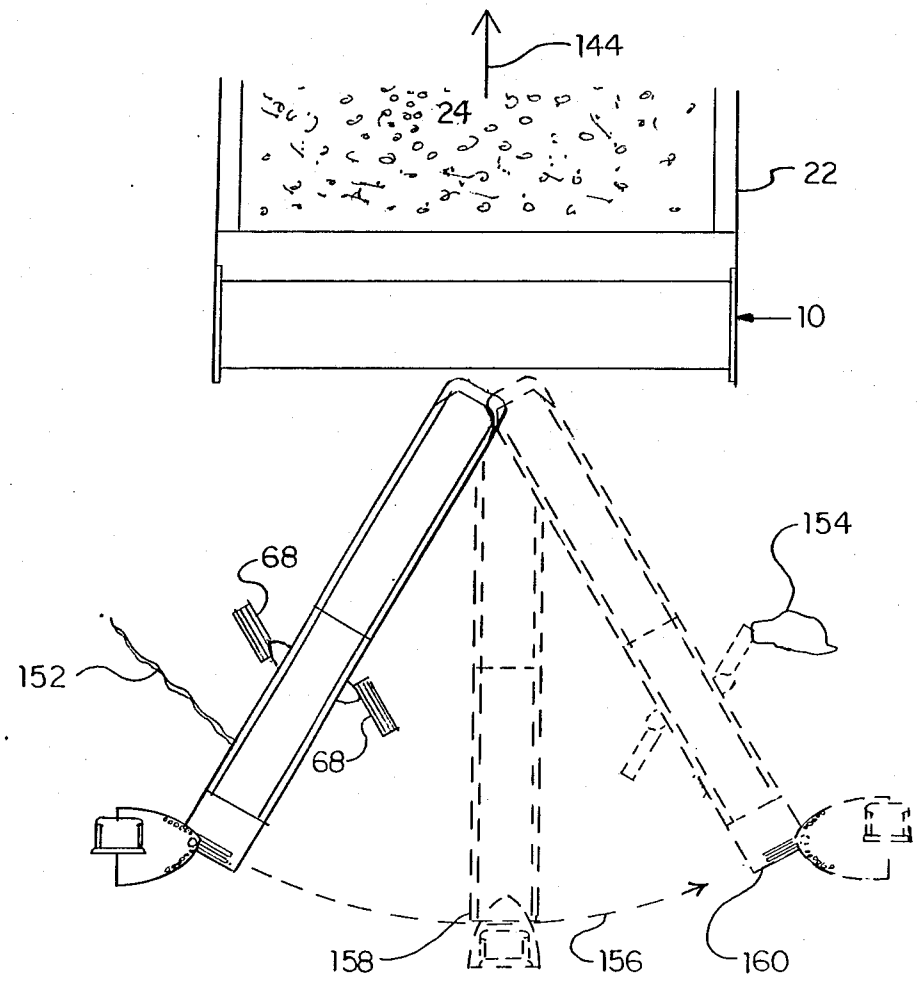
FIG. 4 a schematic view of the present invention in operation.

As shown in FIG. 4, the apparatus of the present invention is towed behind a dump truck 22. The device is capable of moving in an arc of almost 180° behind the dump truck. As the truck moves forward in the direction of arrow 144, the device may be swung to the left in order to fill crack 152. In this mode, it can be seen that the wheels 68 are turned such that they follow the direction of the crack and the operator station is pivoted about axis 120 all the way to the left so that the operator may observe the crack 152. The operator seat 132 is pivoted about axis 136 so that the operator is facing forward in the direction of travel 144. Also, the spreader means 84 is rotated such that the transverse scraper means 112 is oriented perpendicular to the general direction of travel of crack 152. After the crack 152 is filled, the device can be swung in an 156 arc to the opposite side of the roadway in order to fill pothole 154. As can be seen by the phantom outline of the device during its movement about arc 156, the intermediate position 158 shows that the wheels 68 are pivoted in order to permit sideways movement of the device. When the device is positioned as in the phantom lines 160, the wheels are positioned to move the spreader means over the pothole 154. When the pothole 154 the spreader means is rotated approximately 90° from that when filling crack 152 and the operator station has been pivoted outwardly approximately 180° from its position when filling crack 152.

When effecting the movement as shown in FIG. 4, the device can be powered by the hydraulic motor on the wheels, or it can be passively moved by pointing the wheels in the proper direction and permitting the dump truck 22 to provide the locomotion.

Conventionally, a motorized roller is used to compress the asphalt newly laid so as to decrease the chance that it will be forceably removed from the pothole or crack as traffic runs over the newly laid asphalt. While not shown in the drawings herein, a simple roller could be affixed immediately behind the spreader means 84 so as to automatically compress the newly laid asphalt, thereby eliminating the need for additional equipment and man power.

Therefore, it can be seen that the present invention provides a novel apparatus for patching asphalt roadways which reduces much of the labor normally required, but is relatively inexpensive to purchase and maintain. It is to be understood that numerous modifications of the various parts of the present invention may be apparent to those of ordinary skill in the art. The foregoing specification is not intended, by the recitation of specific elements or modes of operation, to limit the applicability of the present invention or to suggest exclusive means of operation. Therefore, the scope of the present invention should be determined solely by the scope of the claims appended hereto.

I claim:

1. An asphalt patching device comprising:
   a. an auger adapted to be affixed to the tailgate of a dump truck so as to deliver asphalt from said dump truck;
   b. hopper means affixed to a wheeled frame which is removably attached to said dump truck, the hopper being adapted to distribute asphalt to a location to be patched;
   c. at least one conveyor positioned to deliver asphalt from said auger to said hopper;
   d. rotatably adjustable spreader means affixed to the underside of said hopper, said spreader means being rotatable about a vertical axis disposed through the hopper and spreader means, and
   e. the spreader means being vertically adjustable relative to and independent from the wheeled frame.

2. The device as recited in claim 1, wherein each of the wheels of said wheeled frame are provided with power means sufficient to provide locomotion to said device and said dump truck.

3. The device as recited in claim 2, wherein said wheels are adapted to pivot about 180° about a vertical axis such that said device can be moved in an arc of about 180° behind said dump truck.

4. The device as recited in claim 1, wherein said at least one conveyor comprises two conveyors in telescoping arrangement, to provide continuous transport of asphalt from said auger to said hopper.

5. The device as recited in claim 4, wherein said conveyors are adapted to telescope one within the other in order to increase or decrease the distance between said auger and said hopper.

6. The device as recited in claim 1, wherein the spreader means comprises transversely adjustable lateral wing members having inner planar surfaces defining a transverse dimension of an asphalt patch.

7. The device as recited in claim 7, wherein said spreader means further comprise vertically adjustable transversely disposed scraper means which defines the vertical thickness of an asphalt patch.

8. The device as recited in claim 1, wherein said spreader means is affixed to a turntable which is rotatably adjustable in a 360° arc about a vertical axis.

9. The device as recited in claim 1, wherein said device further comprises roller means positioned in a direction rearward from said spreader means, such that the roller means compacts asphalt deposited by the spreader means.

10. The device as recited in claim 1, wherein said hopper means and said spreader means are vertically adjustable between an upper position. and a lower position, said upper position being adapted for transport of said device to a work area and said lower position being adapted for use in applying an asphalt patch at a work area.

11. The device as recited in claim 1, further comprising an operator seat pivotally mounted to said wheeled frame such that an operator is enabled to face in a forward direction regardless of the orientation of the device.

12. An asphalt patching device having a longitudinal axis coinciding with a direction of travel and a transverse axis perpendicular thereto, comprising:
   a. an auger mounted about said transverse axis and adapted to be affixed to the tailgate of a dump truck, said auger having at least one exit port for distribution of asphalt from said dump truck;
   b. hopper means affixed to a wheeled frame, said hopper comprising means for receipt and distribution of asphalt to an area to be patched;
   c. at least one conveyor having a receipt end to receive asphalt from said auger and a discharge end to discharge asphalt into said hopper; and
   d. vertically and rotatably adjustable spreader means affixed to said hopper, said spreader means being rotatable about a vertical axis disposed through the hopper and spreader means, such that the transverse dimension and the thickness of an asphalt patch can be varied.

13. The device as recited in claim 12, wherein said wheeled frame comprises a power source for each wheel and wheels adapted to pivot about a vertical axis such that said device can be moved in an arc behind said dump truck.

14. The device as recited in claim 12, wherein said conveyors are secured to telescoping members adapted to increase or decrease the distance between said auger and said hopper.

15. The device as recited in claim 12, wherein the spreader means comprise transversely adjustable lateral wing members having inner planar surfaces defining a transverse dimension of an asphalt patch.

16. The device as recited in claim 15, wherein said spreader means further comprise vertically adjustable transversely disposed scraper means which defines the vertical thickness of an asphalt patch when the device is moved along said longitudinal axis.

17. The device as recited in claim 12, wherein said spreader means is affixed to a turntable which is rotatably adjustable in a 360° arc about a vertical axis.

18. The device as recited in claim 12, wherein said hopper means and said spreader means are vertically adjustable between an upper position and a lower position, said upper position being adapted for transport of said device to a work area and said lower position being adapted for use in applying an asphalt patch at a work area.

19. The device as recited in claim 12, further comprising an operator seat pivotally mounted to said wheeled frame such that an operator is enabled to face in a forward direction regardless of the orientation of the device.

* * * * *